United States Patent [19]

Docx

[11] 4,272,670

[45] Jun. 9, 1981

[54] FURNACE MUFFLES AND FURNACES

[76] Inventor: Albert G. Docx, 70 Ellesmere Rd., Altrincham, Cheshire, England

[21] Appl. No.: 20,684

[22] Filed: Mar. 15, 1979

Related U.S. Application Data

[63] Continuation-in-part of Ser. No. 792,953, May 2, 1977, abandoned.

[30] Foreign Application Priority Data

May 1, 1976 [GB] United Kingdom ..... 17893/76
May 19, 1978 [GB] United Kingdom ..... 20820/78

[51] Int. Cl.[3] ..... H05B 3/66

[52] U.S. Cl. ..... 219/390; 13/22; 338/303; 219/542

[58] Field of Search ..... 219/390, 521, 542, 546, 219/412–414, 535; 13/22, 29, 25; 432/250; 110/173 A, 176–179; 338/296, 298, 302, 303, 311, 321, 318

[56] References Cited

U.S. PATENT DOCUMENTS

| | | | |
|---|---|---|---|
| 596,696 | 1/1898 | Custer | 219/390 |
| 657,202 | 9/1900 | McBrair | 219/414 |
| 1,143,579 | 6/1915 | Denhard | 219/390 |
| 1,534,592 | 4/1925 | Houck | 219/390 |
| 2,162,030 | 6/1939 | Piazzoli, Jr. | 338/318 |
| 2,490,602 | 12/1949 | Schick | 219/542 |
| 2,561,640 | 7/1951 | Steinbock, Jr. | 219/390 |
| 3,100,251 | 8/1963 | Johnson | 219/390 |
| 3,786,162 | 1/1974 | Colson | 219/390 |

FOREIGN PATENT DOCUMENTS

| | | | |
|---|---|---|---|
| 512740 | 6/1928 | Fed. Rep. of Germany | 219/542 |
| 1441577 | 7/1976 | United Kingdom | 219/390 |
| 372285 | 4/1971 | U.S.S.R. | 219/390 |

*Primary Examiner*—Elliot A. Goldberg
*Assistant Examiner*—Bernard Roskoski
*Attorney, Agent, or Firm*—Sughrue, Rothwell, Mion, Zinn and Macpeak

[57] ABSTRACT

A furnace is described which comprises an insulated muffle comprising a ceramic fibrous body into which work pieces may be directly introduced through an opening. A closure member is arranged to close the opening, and means are provided for energizing a coiled heating element disposed in an open channel within the body and for controlling the rate at which the muffle is heated. The opening is arranged at the top of the muffle so as to ensure its rapid cooling subsequent to removal of the closure member therefrom. To enable the muffle to withstand rapid cooling, and in particular to retain the heating element in position, a plurality of strips of ceramic fibrous material are cemented diagonally across the top of the open channel. The closure member may be latched in the closed position by atmospheric pressure as the result of evacuating the interior of the furnace.

4 Claims, 9 Drawing Figures

FURNACE MUFFLES AND FURNACES

This application is a continuation-in-part of my earlier application No. 792,953, filed May 2, 1977, now abandoned and relates to furnace muffles and furnaces.

A variety of muffle furnaces are available which are designed for the firing of ceramic work pieces such as are required for example for dental applications. Ceramic work pieces must be heated in accordance with a predetermined heating programme from a relatively low temperature to a relatively high baking temperature if satisfactory results are to be obtained. The known furnaces generally compris a muffle adapted to be maintained at a high temperature and a transport mechanism for transporting work pieces into the muffle at a controlled slow speed. The speed at which the transport mechanism moves relative to the muffle controls the preheating program.

The transport mechanisms employed, which have to achieve slow, substantially vibration free movement are costly both in terms of production and maintenance, and in addition the transport mechanisms increase the size of the furnace to an undesirable extent. Furthermore, as work pieces are advanced by the transport mechanism towards the muffle they initially receive radiant heat from the muffle on only one side. The resulting non-uniform heating is not desirable.

Furnaces incorporating transport mechanisms have been used as it has not been thought possible to achieve the desired heating program satisfactorily simply by placing a work piece in a muffle and controlling the temperature within the muffle by controlling the energy supplied. The primary reason for this is that it has been conventional practice to manufacture muffles with a solid refractory support base possessing a high heat storage capacity and a general structure which is designed to maintain the muffle at a substantially constant high temperature. As a result, once a furnace has been heated, it takes a considerable time for it to cool down to a sufficiently low temperature as to enable a ceramic work piece firing sequence to be initiated. The furnace is of course inoperative during the cooling period which greatly reduces its productive capacity.

Furthermore, subjecting muffle furnaces to rapid heating and cooling cycles over a temperature range of in excess of 1000° C. as required in dental furnaces has not been considered in the past as the solid refractory support base of available muffles would soon be destroyed by rapid heating and cooling.

In my British Pat. No. 1350574 I describe a muffle comprising an electric heating element partially embedded in a support of ceramic fibrous material. Such a muffle can withstand rapid heating which would result in cracking of a solid refractory support such as is used in earlier muffles and therefore my earlier proposal did constitute an improvement on the prior art. Unfortunately those portions of the heating element embedded in the ceramic fibrous support tended to overheat and therefore the heating element had to be operated at a low rating if the development of "hot spots" leading to burning out of the element was to be avoided. Furthermore the breaking strength of the ceramic fibrous material is low and the heating element tended to tear itself out of the support. When this happened the muffle rapidly became unusable as a result of the heating element being pulled out of position. This adverse effect was particularly noticeable where the heating element was wound around the inside of a tubular supporting body as in such muffles contractions of the element tend to straighten it and thereby automatically pull it towards the interior of the muffle.

One way to overcome the problem of "hot spots" causing the heating element to burn out is to simply lay the heating element in an open channel. Such a proposal is made by Colson in U.S. Pat. No. 3,786,162 which shows a tubular ceramic fibrous support which is provided internally with elongate open recesses receiving a heating element. The heating element is retained in position by being laid in a slight depression in the base of the recess.

The Colson disclosure specifically relates to a furnace which is suitable for use by amateur hobbyists which could not possibly be subjected to many cycles of rapid heating and cooling as it would rapidly become unusable as a result of the heating element pulling out of the recesses. The contraction forces on the element would be so great that positioning the element in a depression would be of no consequence. The exemplary heating procedure described by Colson includes a heating programme lasting from seven to nine hours which by any standards is slow.

One way to overcome the problem of the heating element tearing itself free from its support is to arrange the heating element behind a rigid framework of members against which the element can bear. Such a proposal is made by Schick in U.S. Pat. No. 2,490,602 which describes a heating plate formed by a grooved flat support, a heating element arranged in the grooves, and guard strips formed from sheets of mica secured over the grooves to prevent the heating element rising up above the surface of the plate. The problem with applying the techniques of Schick to rapid cycle furnaces having tubular rather than planar heating surfaces is that the guard strips must be relatively close together if the heating element is not to be pulled into the muffle interior between adjacent strips. This leads to the formation of many "hot spots" as heat cannot radiate freely from the portions of the heating element behind the guard strips. Premature burnout again results.

It is a primary object of the present invention to provide a furnace muffle which can withstand rapid heating and cooling cycles.

If a furnace is to be operated with rapid heating and cooling cycles it is necessary to provide a reliable means for latching the furnace door in the closed position and for reliably opening the door when rapid cooling is to be achieved. Obviously a mechanical latch and release mechanism can be used but such a mechanism requires close manufacturing tolerances and can become unreliable due to wear or rough handling.

It is a further object of the present invention to provide an improved furnace door latching system.

The present invention provides a furnace muffle for firing ceramic work pieces, such as dental fixtures, comprising a hollow cylindrical ceramic fibrous support member, an open channel defined on the inside of said support member, a coiled heating element loosely disposed in said channel, and a plurality of strips of ceramic fibrous material cemented across the opening of said channel for retaining said heating element therein.

The invention also provides a muffle furnace comprising a muffle housed in a container, a lid pivotal between a closed position in which it closes an opening in said container and an open position in which said lid is located away from said opening, means for biasing said lid to said open position, and a vacuum pump for evacuating gas from the interior of said containers, said lid being movable manually to said closed position, such movement actuating a switch which starts said pump and thereby generates a pressure difference across the lid sufficient to maintain the lid in its closed position, and means being provided to release the vacuum within said container to thereby enable said lid to be moved to said open position by said biasing means.

Embodiments of the invention will now be described, by way of example, with reference to the accompanying drawings, in which.

Figure 1:
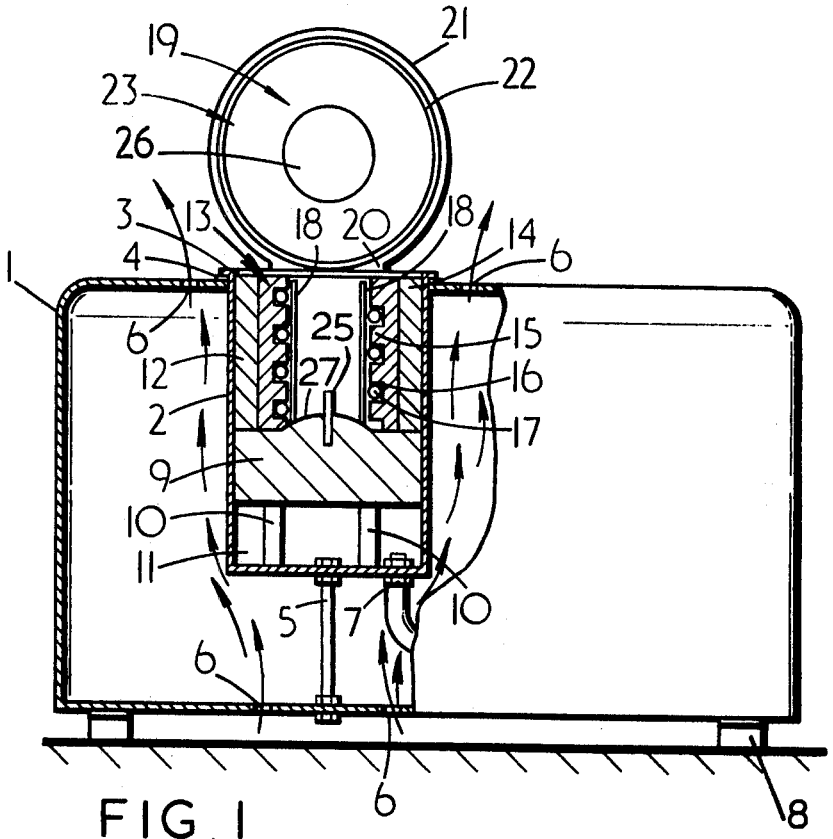
FIG. 1 is a part sectional front view of a furnace embodying the present invention.

Referring to FIG. 1, the illustrated furnace comprises a casing 1 of sheet steel defining a circular aperture in which a spun aluminium container 2 is located. The container 2 has a lip 3 which overlaps the edge of the aperture in the casing 1 and a resilient ring 4 resting on the casing. The lip 3 is pressed against the ring 4 by the action of a nut and bolt assembly 5 secured to the container 2 and to the bottom of the casing 1. A series of apertures 6 are provided in the casing around the nut ad bolt assembly 5. A connector 7 enables a vacuum pump (not shown) to be used to evacuate the container 2. The casing 1 is supported on legs 8 to enable air to circulate beneath the casing 1 to the lower apertures 6.

Figure 2:
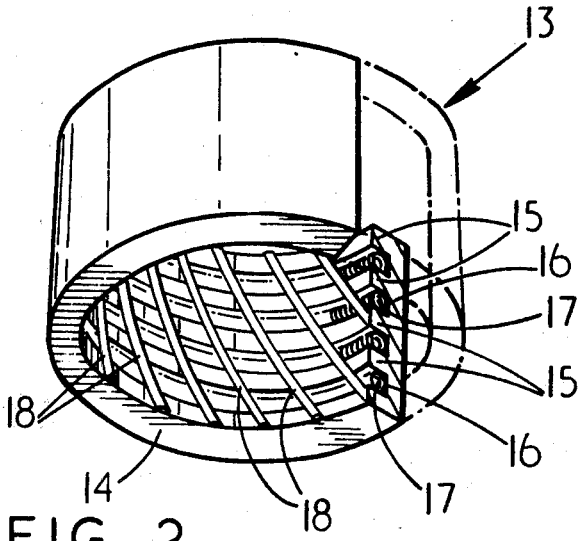
FIG. 2 is a perspective cut-away view of a muffle incorporated in the furnace of FIG. 1.

A pad 9 of a ceramic fibrous material is supported within the container 2 on legs 10 so as to define an airspace 11. A ring 12 of ceramic fibrous material rests on the pad 9 and a muffle 13 is located on the pad 9 inside the ring 12. As may be more clearly seen from FIG. 2, the muffle 13 comprises a tubular body 14 of ceramic fibrous material within which a strip 15 of generally rectangular section is would in a helical path. A channel 16 is defined between adjacent turns of the strip 15 and a coiled heating element 17 is located within this channel. Further strips 18 of ceramic fibrous material are secured by cement across the top of the channel 16 so as to retain the heating element 17 in position. The strips 18 are arranged to cross the channel 16 at an angle such that adjacent windings of the coiled heating element are inclined thereto. This prevents the strips 18 sliding between adjacent windings of the heating element.

The strips 18 are of substantially circular section such that the heating element makes only point contact with them. This ensures that heat can freely radiate from those portions of the element located behind the strips, thereby avoiding the formation of "hot spots" which would lead to premature burn-out of the element.

Preferably the strips 18 are formed from a cord of ceramic fibrous material. Such cords are available from the suppliers of ceramic fibrous materials in the form of multi-cord rope of approximately four millimeters diameter. I have found that individual cords taken from such rope and having a diameter of less than two millimeters are highly suitable. The spacing between adjacent strips, measured perpendicular to their general direction, may be approximately fifteen millimeters for example.

The cords are initially dipped into and therefore impregnated throughout with a slurry of milled ceramic fibre and a liquid rigidiser. The liquid regidiser is a liquid binder such as TRITON HARDNER, which is a high purity water based colloidal silica solution containing traces of sodium silicate and chloride ions marketed by Morganite Ceramic Fibres Limited. The impregnated cords are then placed in position across the top of the channel 16 and secured in position by a cement formed from chopped ceramic fibres and the liquid rigidiser. Thereafter further cement is painted over the cords 18 and the top surface of the fibrous strip 15 so that all the accessible inner surface of the muffle has a cement-hardened surface. The muffle is then kiln dried. Although there are some minor irregularities in the cross-sections of the cords the cords nevertheless are generally circular in section so that the desired point contact with the heating element is obtained.

As an alternative to defining the channel 16 between adjacent turns of the strip 15, the channel can be cut from a tubular body having a small thickness equal to the sum of the thicknesses of the body 14 and strip 15 of FIG. 1.

A closure member in the form of a lid 19 is supported by a pivot 20 on the casing 1. The lid 19 comprises a stainless steel cap 21 supporting an insulating body 22 of ceramic fibrous material. An O-ring 23 is arranged around the edge of the lid 19 so that when the lid is closed an air-tight seal is formed between the O-ring and the lid 19 and the O-ring and the lip 3 of the container 2.

Figure 3:
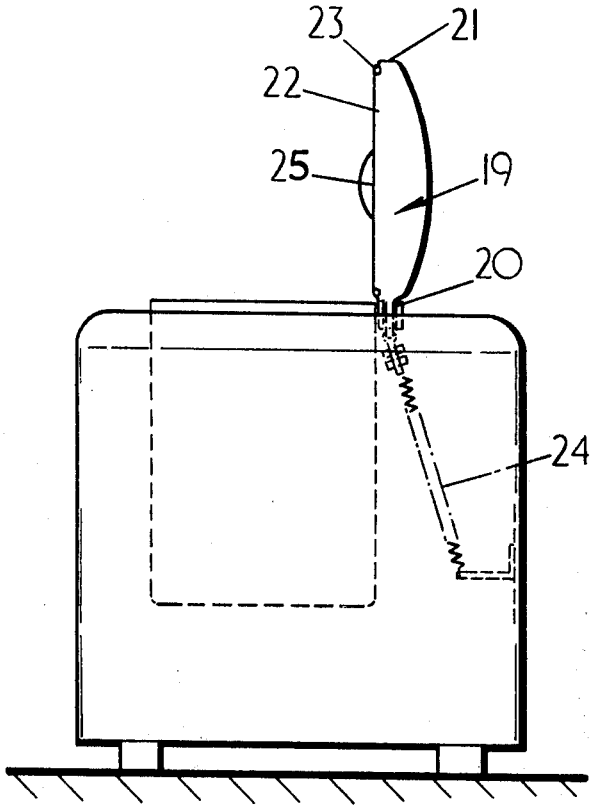
FIG. 3 is a side view of the furnace of FIG. 1.

The lid 19 is counter-balanced by a spring 24, and may be held in a closed position against the action of the spring 24 by a vacuum latch as described hereinafter with reference to the embodiment of FIGS. 6 to 9. The latch may be released by for example a solenoid (not shown). When the latch is released the spring 24 raises the lid 19 to the position shown in FIG. 3 in which the spring 24 is in an "over-centre" position relative to the pivot 20.

In use, workpieces that are to be fired are placed on a support (not shown) and the support is placed in the muffle. The pad 9 (FIG. 1) at the bottom of the muffle supports a pin 25 with which the support engages. After the support has been positioned in the muffle, the lid 19 is closed and a heating sequence may be initiated. The body 22 of the lid 19 supports a convex dome 26, and the pad 9 supports a convex dome 27. The pin 25 ensures that the workpiece support is located centrally within the muffle and the domes 26, 27 reflect energy from the heating element substantially uniformly.

When a heating sequence has been completed, the lid 19 is raised. As the muffle is now fully open to the atmosphere it cools rapidly, the cooling being enhanced by air flow in the direction of the arrows in FIG. 1 from the lower to the upper apertures 6 in the casing 1. Although the heating element 17 is only resting in the muffle wall, it is adequately restrained from drift with a minimum amount of physical contact by the ceramic fibre strips 18. This allows free radiation of heat without "hot spots" developing and thus enhances rapid cooling. The structure of the muffle and its surrounding insulation is such that the heat capacity of the furnace is relatively low and therefore the energy which has to be dissipated to cool the muffle is also relatively low.

Figure 4:
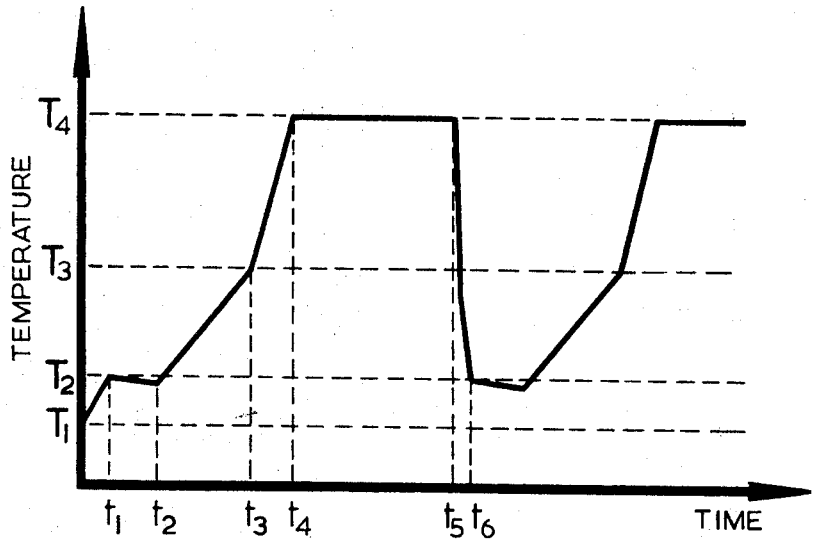
FIG. 4 is a graph illustrating the variations of the temperature in the muffle during the operation of the illustrated furnace.

Referring now to FIG. 4, a graph (not to scale) is shown which illustrates a particular heating sequence which may be obtained with the illustrated furnace when controlled by electronic apparatus such as will be generally described hereinafter with reference to FIG. 5.

Starting from ambient temperature $T_1$ the furnace is heated to a temperature $T_2$ at time $t_1$. Workpieces are then located within the muffle and the lid 19 is closed and latched. No further heating occurs until time $t_2$. This enables the workpieces and support to come to equilibrium with the furnace. The furnace is then steadily heated to temperature $T_3$ at time $t_3$ to dry and preheat the workpieces. The air in the space 11 ensures that any dyes or starches gassed off from the workpieces can be absorbed despite the fact that the furnace is sealed. At time $t_3$, the container 2, is evacuated and the heating is continued at a different steady rate until temperature $T_4$ is reached at time $t_4$. The temperature $T_4$ is then maintained until time $t_5$ when the lid 19 is released and swings open automatically. Opening of the lid 19 automatically de-energises the heating element and rapid cooling takes place. When the temperature $T_2$ is reached, fresh workpieces can be located in the furnace and a fresh sequence started.

Figure 5:
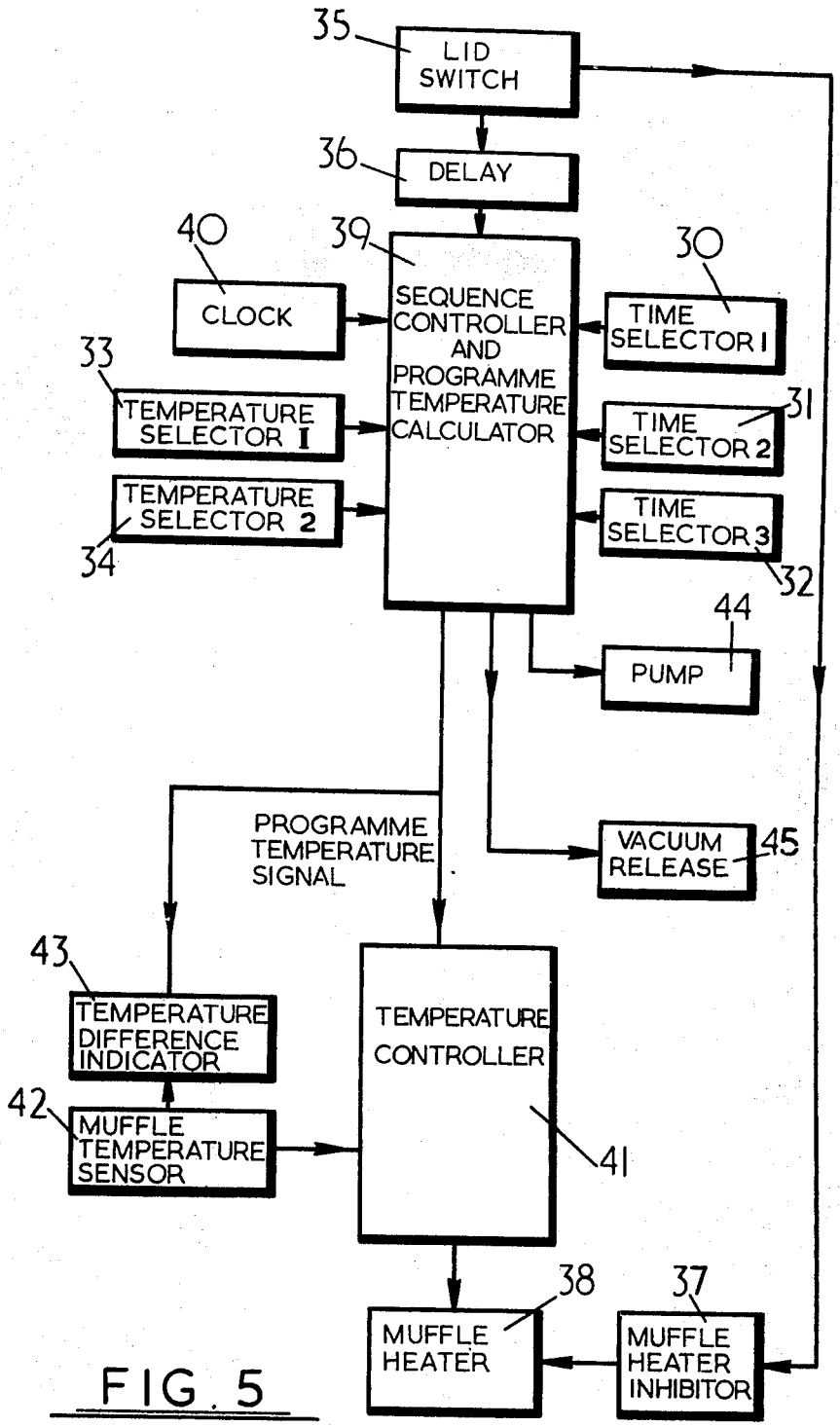
FIG. 5 is a block diagram illustrating a heating programme controller suitable for controlling the furnace of FIG. 1.

Referring now to FIG. 5, the control of the sequence will now be described starting from time $t_1$ as indicated in FIG. 4.

A heating sequence is manually programmed by adjusting time selectors 30, 31 and 32 to set periods ($t_3$–$t_2$), ($t_4$–$t_3$) and ($t_5$–$t_4$) respectively and adjusting temperature selectors 33 and 34 to set temperatures $T_3$ and $T_4$ respectively. Workpieces are then placed in the furnace, and the lid is closed.

Closure of the lid sends a signal from a lid switch 35 to a delay unit 36 and a muffle beater inhibitor 37, the latter subsequently enabling energisation of the heating coil by a muffle heater 38. After a predetermined period such as one minute determined by the delay unit 36 a signal is applied to a sequence controller and program temperature calculator 39 which receives inputs from selectors 30 to 34 and from a clock 40.

The controller and calculator 39 provides a signal indicative of the desired programme temperature as determined by selectors 30 to 34, the signal varying with time in a manner apparent from FIG. 4. The desired program temperature signal is applied to a temperature controller 41 which also receives a signal indicative of actual muffle temperature from a muffle temperature sensor 42. The sensor 42 may be a conventional thermosensitive device supported by a wire loop (not shown) extending into the muffle interior. The unit 41 controls the muffle heater 38 so as to cause the actual muffle temperature to follow the programmed temperature. A temperature difference indicator 43 also receives the two signals applied to the controller 41 so that any differences between the actual and programmed temperatures can be monitored.

The controller 39 provides outputs to a vacuum pump 44, and to a vacuum release circuit 45. The pump is turned on and off at selected times and the vacuum release circuit is operated at the end of a heating cycle. When the vacuum is released and the lid opened the inhibitor 37 prevents further energisation of the muffle heater. A further cycle may be commenced after the furnace has cooled to temperature $T_2$.

It will be appreciated that the ability to adjust temperatures $T_3$ and $T_4$ and intervals ($t_3$–$t_2$), ($t_4$–$t_3$) and ($t_5$–$t_4$) electronically gives a wide range of possible firing programs.

The above described control arrangement is advantageously mounted within the casing 1.

It will be appreciated that alternative control arrangements to that described with reference to FIG. 5 could be provided.

A ceramic fibrous material suitable for the manufacture of the described muffle is marketed by Morganite Ceramic Fibres Limited under the trade name TRITON KAOWOOL.

Figure 6:
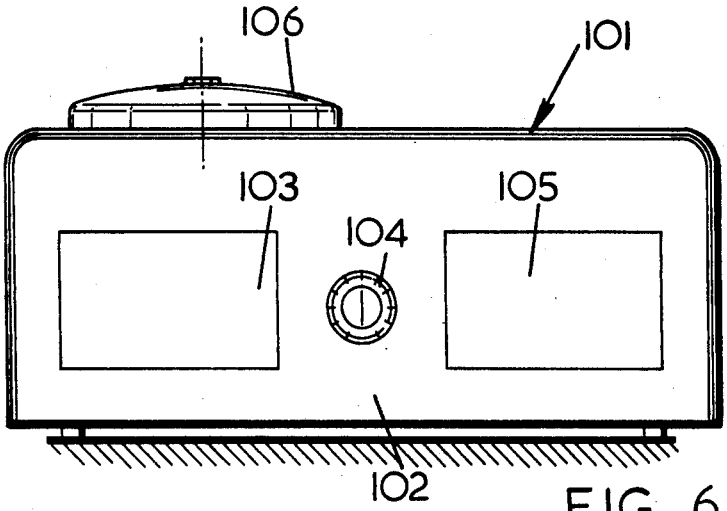
FIGS. 6 and 7 are front views of a second embodiment of the invention, one showing the furnace closed and one showing the furnace open.
Figure 7:
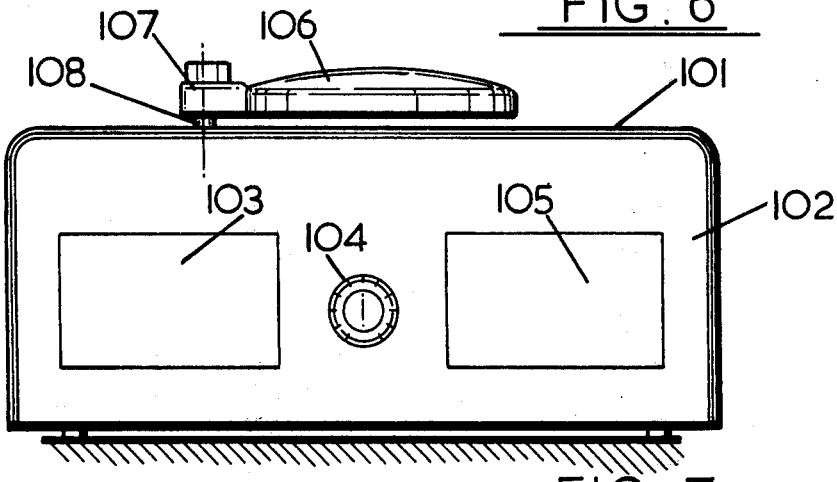

Referring now to FIGS. 6 and 7, the illustrated furnace comprises a casing fabricated from an upper sheet metal panel 101 in the shape of an inverted U and a front sheet metal panel 102. Control devices and indicators 103, 104 and 105 are mounted on the front panel 102 but will not be described in detail. The casing is of course completed by rear and base panels (not shown).

A furnace container is mounted in the left hand half (as seen in FIGS. 6 and 7) of the casing. A lid 106 may be located in the position shown in FIG. 6 in which it seals the container or in the position shown in FIG. 7 away from the container. The lid is supported by a member 107 rigidly secured to a pivot 108 (FIG. 7).

Figure 9:
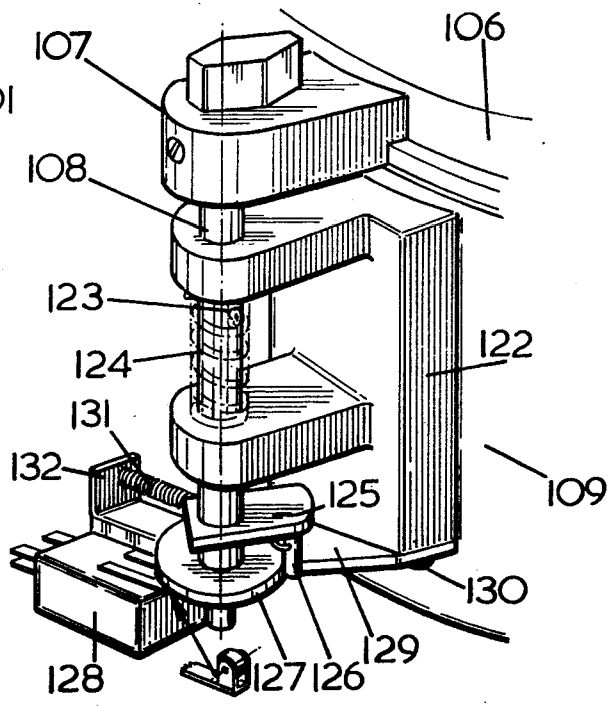
FIG. 9 is a perspective view of the lid support mechanism shown in FIG. 8.
Figure 8:
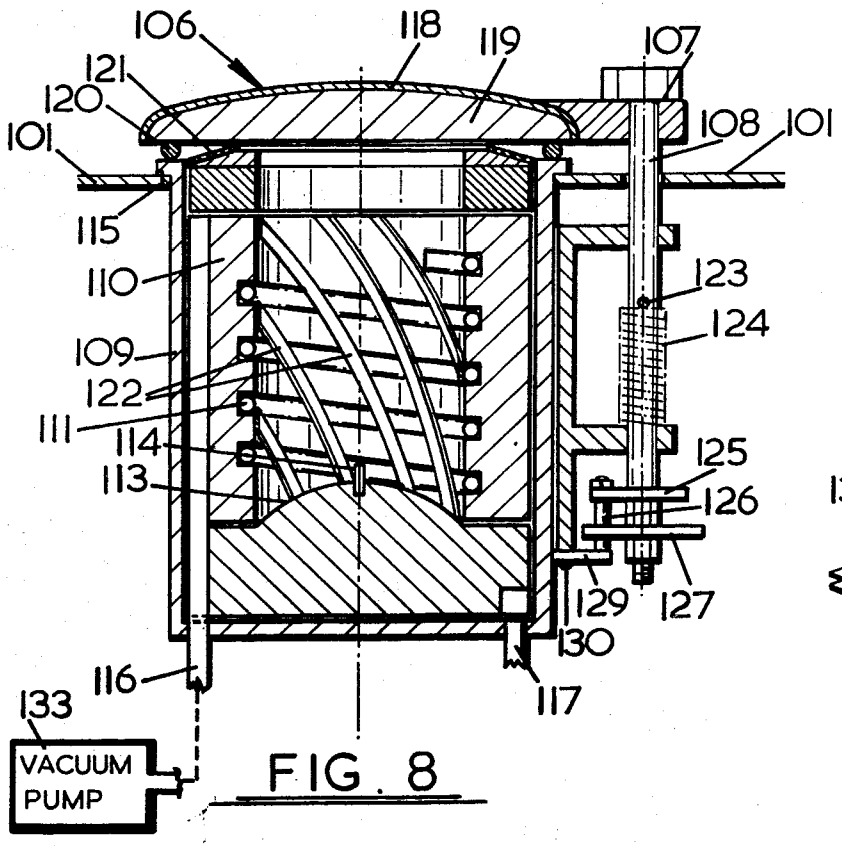
FIG. 8 is a schematic sectional view of the furnace of FIGS. 1 and 2.

Referring now to FIGS. 8 and 9, details of the container and the lid mechanism are shown. The container comprises a cup-shaped vessel 109 receiving a muffle 110 incorporating a coiled heating element 111. The muffle 110 is located between upper and lower members 112 and 113, the lower member supporting a pin 114 for receiving a workpiece support (not shown). The container has a flanged lip 115 which bears on the upper panel 101, an elongated outlet 116 and short inlet 117, both outlet 116 and inlet 117 passing through the container base. The lid 106 comprises an outer-casing 118 supporting an insulating member 119. A sealing ring 120 is supported on the lower face of the lid. An aluminum ring 121 is located over member 112. Members 110, 112, 113 and 119 are fabricated from a ceramic fibrous material. Strip 122 of ceramic fibrous material retain the heating element 111 in position. The manner of fabricating the strips 122 corresponds to that of strips 18 as described in detail with reference to FIGS. 1 and 2.

The pivot 108 is mounted in bearings defined by a bracket rigidly secured to the container. The pivot supports a pin 123 against which compression spring 124 bears to bias the pivot and thus the lid 106 upwards. The pivot 108 also supports a plate 125 in which a further pin 126 is supported and a disc 127 against which the actuating lever of a microswitch 128 (FIG. 9) bears.

In addition to supporting the pivot 108, the bracket is provided with a lower edge on which a plate 129 is mounted. The plate 129 is slidable in the direction perpendicular to the plane of FIG. 8 and may be locked in position by a screw 130. In FIGS. 8 and 9, the mechanism is shown in the position in which the lid is closed on the container 109. In this position, the pin 126 extends below plate 129 closely adjacent the edge thereof.

If it is desired to open the lid by turning the pivot 108, the pivot 108 must be turned such that pin 126 which is mounted eccentrically relative to the pivot axis of pivot 108 moves anticlockwise (FIG. 9). A stop (not shown) prevents the turning of the pivot in the opposite direction. Thus, before the lid can be opened, the pivot 108 must be raised until the lower end of the pin 126 is above the plate 129. Turning can then take place with the pin 126 moving across the upper surface of the plate 129. A spring 131 (FIG. 9) connected between the pin 126 and a bracket 132 automatically opens the lid as soon as the pin 126 rises above the edge of the plate 129.

In operation, the user places workpieces in the muffle and swings the lid so that it is located above the container. The lid is then pressed down against the force of spring 124 until the sealing ring 120 bears against the lip 115. Downward movement of the lid 106 and pivot 108 actuates switch 128 which turns on a vacuum pump 133 connected to outlet 116 and energises the heating element 111. Air is bled into the container 109 via inlet 17. The resulting pressure differential across the lid 106 is sufficient to maintain the lid closed.

The air bled in via inlet 117 passes diametrically across the container, scavenging gassed off vapours in the process. When the temperature in the furnace reaches a first predetermined temperature the bleed valve is shut to give a full vacuum. When a second predetermined temperature is reached, the bleed valve is reopened and the pump is stopped. Thus air is bled into the container via inlet 117. The pressure differential across the lid 106 falls and the spring 124 raises the lid so that pin 126 rises above plate 129. The lid 106 then swings sideways automatically under the influence of the spring 131 connected to the pin 126 and fired workpieces can be removed and placed on an insulating pad (not shown) located on the upper casing panel 101 to the right hand side (FIGS. 6 and 7) of the furnace.

The switch 128 is so connected as to prevent energisation of the muffle until the lid is closed.

The screw 130 enables the position at which the lid can drop to close the container to be easily and accurately adjusted.

What is claimed is:

1. A furnace muffle for firing ceramic work pieces, such as dental fixtures, comprising:
   (a) a hollow cylindrical ceramic fibrous support member,
   (b) an open channel defined on the inside of said support member,
   (c) a coiled heating element loosely disposed in said channel, and
   (d) a plurality of strips of ceramic fibrous material cemented generally diagonally across the openings of said channel for retaining said heating element therein, said strips being substantially circular in cross-section.

2. A furnace muffle according to claim 1, wherein the open channel in which the heating element is disposed is defined by adjacent turns of a coil of ceramic fibrous material secured inside a tubular body of ceramic fibrous material.

3. A furnace muffle according to claim 1, wherein the open channel in which the heating element is disposed is cut in the inner face of a tubular body of ceramic fibrous material.

4. A furnace muffle according to claim 1, wherein the strips are formed from cords of ceramic fibrous material impregnated with a slurry of ceramic fibrous material and a liquid rigidiser.

* * * * *